US009574847B2

(12) United States Patent
Rossi

(10) Patent No.: US 9,574,847 B2
(45) Date of Patent: Feb. 21, 2017

(54) SELF-DISGUISING HOLSTER

(71) Applicant: Jon Rossi, Philadelphia, PA (US)

(72) Inventor: Jon Rossi, Philadelphia, PA (US)

( * ) Notice: Subject to any disclaimer, the term of this patent is extended or adjusted under 35 U.S.C. 154(b) by 0 days.

(21) Appl. No.: 15/006,398

(22) Filed: Jan. 26, 2016

(65) Prior Publication Data

US 2016/0216064 A1 Jul. 28, 2016

Related U.S. Application Data

(60) Provisional application No. 62/107,926, filed on Jan. 26, 2015.

(51) Int. Cl.
*F41C 33/02* (2006.01)
*F41C 33/04* (2006.01)

(52) U.S. Cl.
CPC ..... *F41C 33/0245* (2013.01); *F41C 33/048* (2013.01)

(58) Field of Classification Search
CPC ..... F41C 33/0245; F41C 33/0263; Y10S 224/911; Y10S 224/912
See application file for complete search history.

(56) References Cited

U.S. PATENT DOCUMENTS 5,012,965 A * 5/1991 Miller ..... F41C 33/0209 224/230
5,749,507 A * 5/1998 Wood ..... F41A 23/18 224/255
8,727,294 B1 * 5/2014 Harms ..... F41A 23/18 206/317
2002/0011504 A1 * 1/2002 Cerato ..... F41A 23/18 224/243
2008/0093400 A1 * 4/2008 Stevens ..... F41C 33/0281 224/243
2010/0219216 A1 * 9/2010 Clark ..... F41C 33/0281 224/243
2010/0243492 A1 * 9/2010 Bulthuis, Jr. ..... F41C 33/06 206/317
2012/0255979 A1 * 10/2012 Sitz ..... F41C 33/0245 224/243
2013/0327799 A1 * 12/2013 Sitz ..... F41C 33/0245 224/243

* cited by examiner

*Primary Examiner* — Corey Skurdal
(74) *Attorney, Agent, or Firm* — James A. Italia; Italia IP

(57) ABSTRACT

A holster which obscures presence and identity of the handgun held by the holster is disclosed. The holster comprises an L-shaped frame having a pin. The handgun is installed on the holster by inserting the pin into the barrel of the handgun. The L-shaped frame combined with the installed handgun collectively form a parallelepiped of thickness equal to that of the handgun. The handgun is disguised by visually meshing in complementary fashion with the holster, when concealed beneath a fabric of an article of apparel.

8 Claims, 4 Drawing Sheets

SELF-DISGUISING HOLSTER

CROSS-REFERENCE TO RELATED APPLICATION

This application claims the benefit of U.S. Provisional Application No. 62/107,926, filed on Jan. 26, 2015, the entire contents of which are incorporated herein by reference.

FIELD OF THE DISCLOSURE

The present disclosure relates to holsters for handguns, and more particularly, to a holster engaging a handgun by a pin penetrating the barrel of the handgun.

BACKGROUND

Holsters are used to support handguns on the body of a user of the handgun. In many situations, it is not desirable to have it known that the user is in possession of a handgun. Yet many holsters increase bulk and conspicuousness of a holstered handgun on the body.

In an emergency situation, it may be necessary for the user to withdraw the handgun from the holster very quickly. Holsters often interfere with rapid withdrawal of the associated handgun.

There exists a need for a holster which obscures the nature of the contained handgun, and which enables expeditious withdrawal of the handgun.

SUMMARY

The disclosed concepts address the above stated situation by providing a holster which obscures presence and identity of the handgun held by the holster. To this end, the novel holster has a shape which complements that of a handgun, and which does not add to the thickness of the handgun. The holster has a similar or smaller thickness than its associated handgun. Moreover, the complementary shape may include three sides of a parallelepiped, thereby creating a visual impression that the item, when contained in a pocket of an item of apparel, is some other object such as a cellular telephone or a wallet for example.

The novel holster may be generally L-shaped to interfit with the handgun. The holster has a pin which engages the handgun by being inserted into the barrel of the handgun. The holster may be placed in a pocket of an item of apparel, may be clipped to the inside of apparel, or may be otherwise carried on the body to provide ready access to the handgun without visually revealing the nature and presence of the handgun.

It is an object to provide improved elements and arrangements thereof by apparatus for the purposes described which is inexpensive, dependable, and fully effective in accomplishing its intended purposes.

This and other objects will become readily apparent upon further review of the following specification and drawings.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

DETAILED DESCRIPTION

Figure 1:
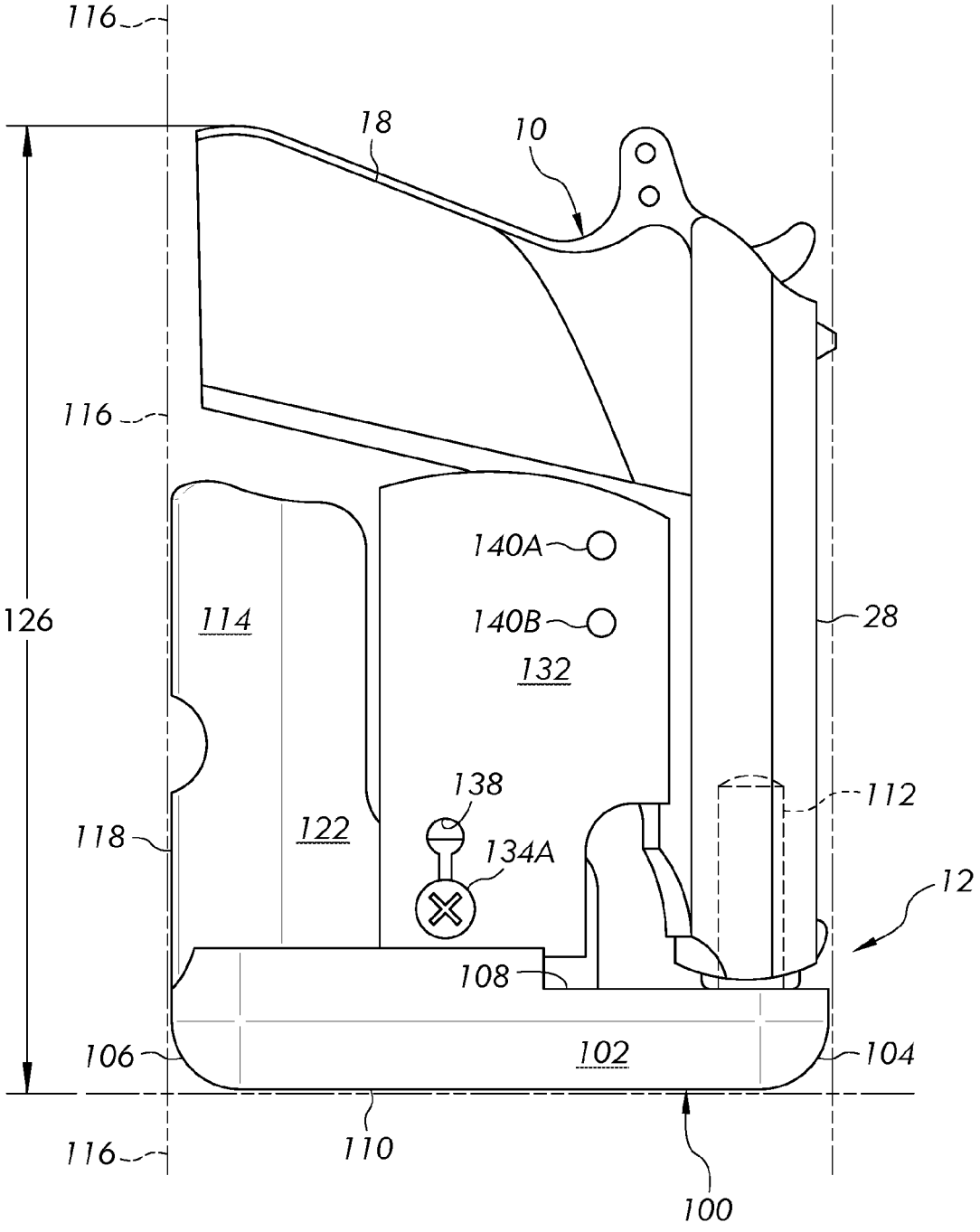
FIG. 1 is a side view of a handgun received in a holster, according to at least one aspect of the disclosure.
Figure 2:
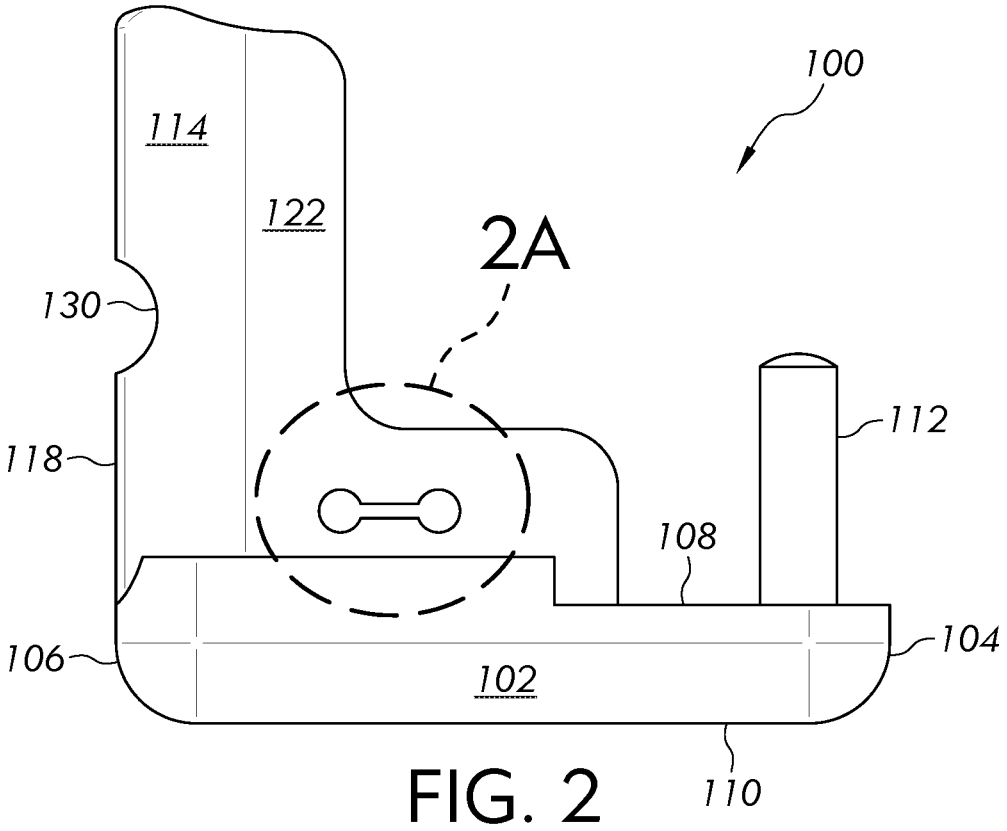
FIG. 2 is a side view of the holster of FIG. 1.
Figure 2A:
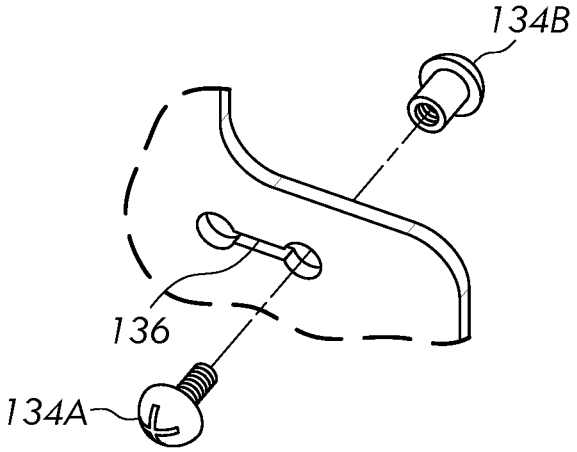
FIG. 2A is a perspective view of the elongated slot of the holster as illustrated in FIG. 2.

Referring first to FIG. 1, according to at least one aspect of the disclosure, there is shown a handgun 10 received in a holster 100. Turning momentarily to FIG. 2, holster 100 is shown isolated from handgun 10.

Holster 100 is for holding and obscuring identity of handgun 10. Holster 100 comprises a base 102 having a proximal end 104, a distal end 106, an inner surface 108 between proximal end 104 and distal end 106, and an outer surface 110 between proximal end 104 and distal end 106. Outer surface 110 is opposite inner surface 108. Base 102 includes a pin 112 (visible in FIG. 2) projecting from inner surface 108 of base 102 proximate proximal end 104. Pin 112 is dimensioned and configured to slidingly engage the inside of a barrel of handgun 10. A bolster 114 projects from inner surface 108 of base 102 at distal end 106 of base 102. Bolster 114 is longer than pin 112. In FIG. 1, length of bolster 114 is along an imaginary projection line 116.

Base 102 is a structural member of holster 100 supporting pin 112 against which a muzzle end 12 of handgun 10 seats. Bolster 114 is a structural member of holster 100 supporting other components to be described hereinafter. Bolster 114 may be perpendicular to base 102, when considering surface 118 of bolster 114 and outer surface 110 of base 102. Base 102 has a maximum width 120 about equal to a width 30 of handgun 10. Holster 100 further comprises a web 124 projecting from bolster 114 towards pin 112. Web 124 extends about the full length 126 of bolster 114 and has a thickness 124 (FIG. 3) less than a width 128 (FIG. 3) of bolster 114.

Figure 3:
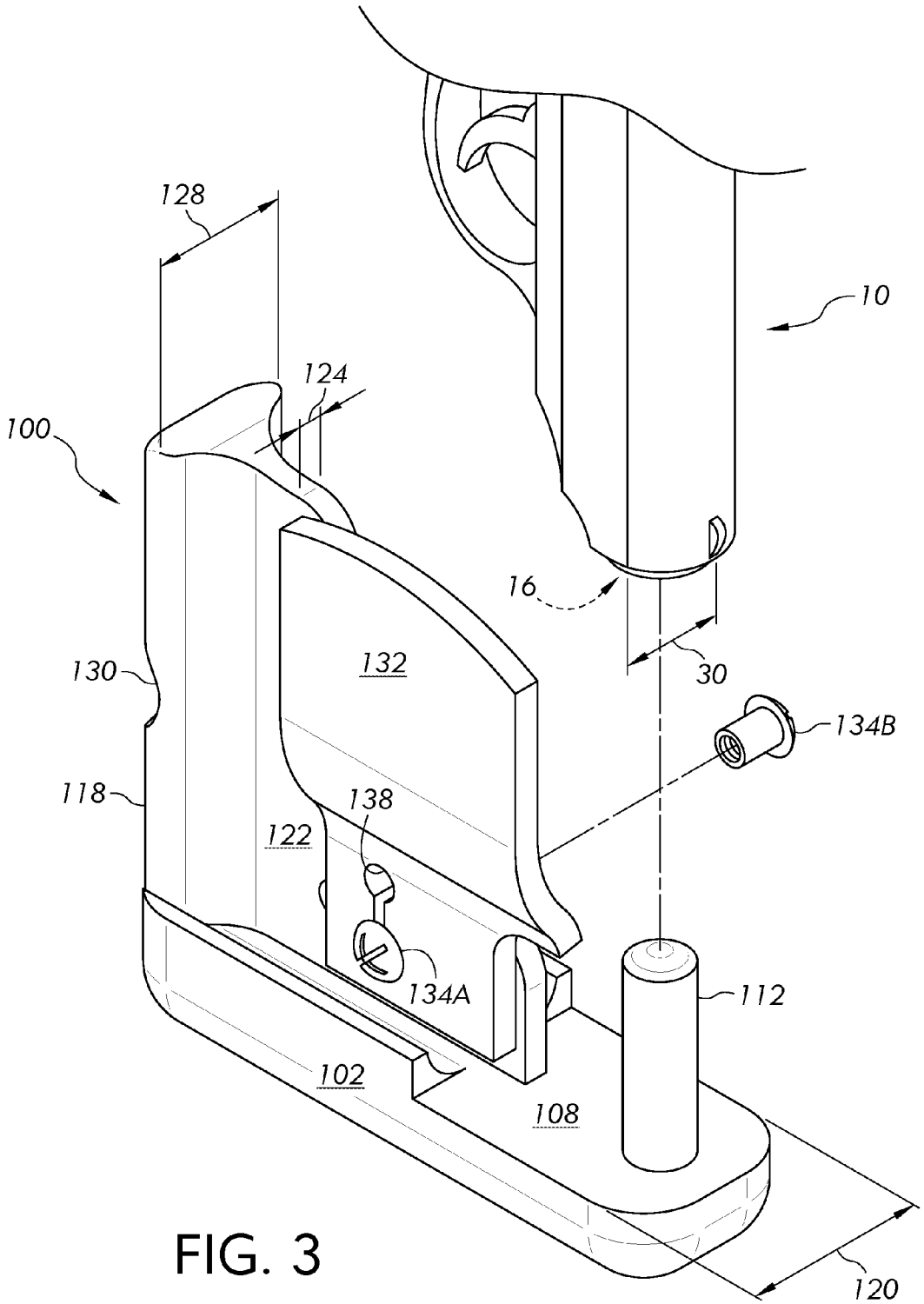
FIG. 3 is a perspective view of the holster of FIG. 2.
Figure 4:
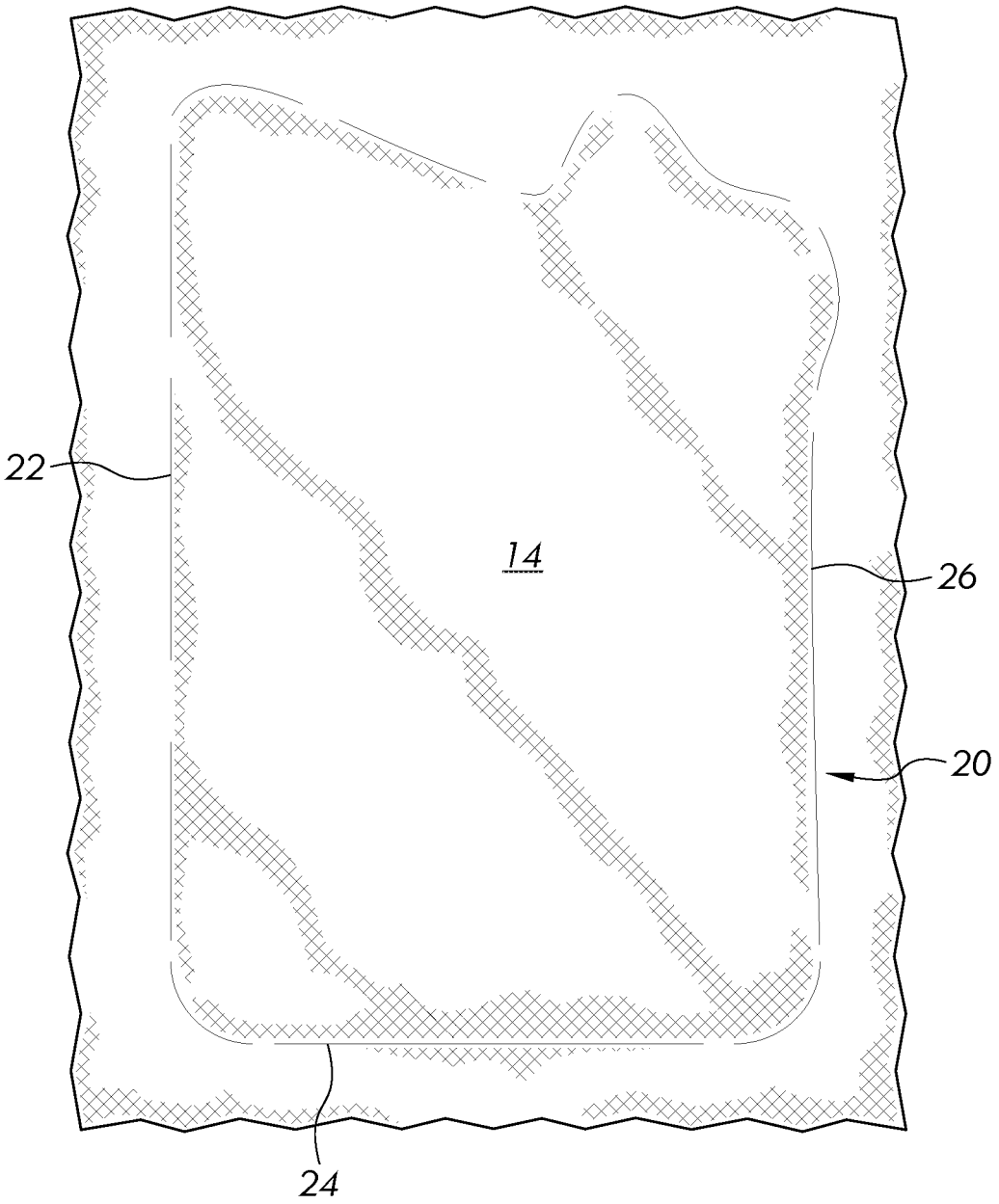
FIG. 4 is a plan view representing fabric of a panel of an article of apparel, shown distended due to the handgun and holster of FIG. 1 having been concealed beneath the fabric.

Referring particularly to FIGS. 1 and 4, but also to FIGS. 2 and 3, holster 100 complements the shape of handgun 10 to simulate at least three sides of a parallelepiped when handgun 10 and holster 100 are covered by a fabric 14 when handgun 10 is installed on holster 100 with pin 12 penetrating a barrel 16 of handgun 10, and with the trigger guard (not individually shown) and a handle 18 (FIG. 1) of handgun 10 received in close cooperation with holster 100. As used herein, simulating at least three sides of a parallelepiped signifies that a bulge 20 (FIG. 4) produced when fabric 14 is distended due to covering holster 100 and handgun 10 has at least three straight sides 22, 24, 26 (FIG. 4) corresponding to outer surface 110, surface 118, and a top surface 28 (FIG. 1) of handgun 10. It is desired to conceal the nature and identity of handgun 10 when the latter is contained within an article of apparel (not shown) and covered by a panel (represented as fabric 14 in FIG. 4) of that article of apparel. This goal is satisfied by having bulge 20 visually suggest that the enveloped item be a parallelepiped such as a cellular telephone or wallet (neither shown), rather than displaying the generally L-shaped configuration of handgun 10. Therefore, it is important that those portions of holster 10 which will influence bulge 20 be straight at their outer surfaces, and complement an available straight line (i.e., top surface 28) of handgun 10. A non-linear fourth border or surface of a true parallelepiped, such as that generated by the somewhat irregular profile of handgun 10 at the rear of handgun 10, the rear being handle 18 and hammer (not shown, but immediately adjacent handle 18), is deemed not objectionable since the overall visual impression will be largely formed by those three straight sides 22, 24, 26 of bulge 20 resulting from outer surface 110 and surface 118 of holster 100, and top surface 28 of handgun 10. Handgun 10 need contact holster 10 only at pin 112, although web 122 may be L-shaped or otherwise configured to interfit in close cooperation with handgun 10 when the latter is installed on pin 112.

Alternatively stated, and now considering the overall thickness of the combination of holster 100 and handgun 10, holster 100 is dimensioned and configured to complement handgun 10 to define a three dimensional envelope with handgun 10 installed on holster 100 with pin 112 penetrating barrel 16 of handgun 10 with the trigger guard and handle 18 of handgun 10 received in close cooperation with holster 100. The envelope has straight first side 22, a parallel opposed second side 26, a third side 24 perpendicular to and between first side 22 and second side 26, and a generally uniform width. The generally uniform width is defined by and about equal to width 120 of base 102, and of course, handgun 10. FIG. 4 provides a plan view of the three dimensional envelope.

Bolster 114 has a maximum width about equal to a width 30 of handgun 10. Therefore, base 102, bolster 114, and handgun 10 all have about equal width. "About equal" signifies that bulge 20 (FIG. 4) generates a visual impression of a parallelepiped to casual observation, thereby concealing the nature of handgun 10.

Views intended to generate the visual impression of the parallelepiped are taken from an angle wherein handgun 10 is viewed from the side, as shown in FIG. 1.

Holster 100 further comprises a recess 130 on an outer side (e.g., surface 118) of bolster 114, for receiving a finger (not shown) of a user, to assist the user in maneuvering holster 100 into place in a pocket of apparel (not shown) worn by the user.

In an option shown in FIGS. 1 and 3, holster 100 further comprises a trigger guard plate 132 and a clamp operable to clamp trigger guard plate 132 to handgun 10. The clamp may comprise a Chicago screw having a male portion 134A and a female portion 134B.

Trigger guard plate 132 is positioned to obstruct lateral finger access to the trigger of handgun 10. To provide versatility in positioning trigger guard plate 132, trigger guard plate 132 includes an elongated slot 138 extending parallel to pin 112, to facilitate adjustment of position of trigger guard plate 132 along an axis parallel to pin 112. Web 122 includes an elongated slot 136 (FIG. 2) extending perpendicularly to elongated slot 138 of trigger guard plate 132, to facilitate adjustment of position of trigger guard plate 132 along an axis (not shown) perpendicular to pin 112.

Referring again to FIG. 1, trigger guard plate 132 may include two posts 140A, 140B projecting perpendicularly therefrom, to surround and immobilize the trigger of handgun 10.

The invention may be thought of as holster 100, or alternatively, as handgun 10 and holster 100 for holding and obscuring identity of handgun 10.

Holster 100 may be fabricated from any rigid material such as a thermosetting plastic, metal, wood, or another synthetic material, or combinations of these. Trigger guard plate 132 may be fabricated from a stiff leather, polymeric material, wood, or other synthetic material.

In the preceding description, numerous specific details are set forth in order to provide an understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Thus, the specific details set forth are merely exemplary. The specific details may be varied from and still be contemplated to be within the spirit and scope of the present invention.

It should be understood that the various examples of the apparatus(es) disclosed herein may include any of the components, features, and functionalities of any of the other examples of the apparatus(es) disclosed herein in any feasible combination, and all of such possibilities are intended to be within the spirit and scope of the present disclosure. Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

I claim:

1. A holster for holding and obscuring identity of a handgun, comprising:

a base having a proximal end, a distal end, an inner surface between the proximal end and the distal end, and an outer surface between the proximal end and the distal end, the outer surface opposite the inner surface, the base including a pin projecting from the inner surface of the base proximate the proximal end, wherein the pin is dimensioned and configured to slidingly engage the inside of a barrel of the handgun;

a bolster projecting from the inner surface of the base at the distal end of the base, wherein the bolster is longer than the pin; and a trigger guard plate and a clamp operable to clamp the trigger guard plate to the handgun.

2. The holster of claim 1, wherein the clamp comprises a Chicago screw.

3. The holster of claim 1, wherein the trigger guard plate includes an elongated slot extending parallel to the pin, to facilitate adjustment of position of the trigger guard plate along an axis parallel to the pin.

4. The holster of claim 1, further comprising a web that includes an elongated slot extending perpendicularly to the elongated slot of the trigger guard plate, to facilitate adjustment of position of the trigger guard plate along an axis perpendicular to the pin.

5. A handgun and holster for holding and obscuring identity of the handgun, wherein:

the handgun has a maximum width; and the holster comprises a base having a proximal end, a distal end, an inner surface between the proximal end and the distal end, and an outer surface between the proximal end and the distal end, the outer surface opposite the inner surface, the base including a pin projecting from the inner surface of the base proximate the proximal end, wherein the pin is dimensioned and configured to slidingly engage the inside of a barrel of the handgun, a bolster projecting from the inner surface of the base at the distal end of the base, wherein the bolster is longer than the pin, and a trigger guard plate and a clamp operable to clamp the trigger guard plate to the handgun.

6. The holster of claim 5, wherein the clamp comprises a Chicago screw.

7. The holster of claim 5, wherein the trigger guard plate includes an elongated slot extending parallel to the pin, to facilitate adjustment of position of the trigger guard plate along an axis parallel to the pin.

8. The holster of claim 5, further comprising a web that includes an elongated slot extending perpendicularly to the elongated slot of the trigger guard plate, to facilitate adjustment of position of the trigger guard plate along an axis perpendicular to the pin.

* * * * *